US008292386B2

(12) United States Patent
Furuya

(10) Patent No.: US 8,292,386 B2
(45) Date of Patent: Oct. 23, 2012

(54) LIQUID DROPLET EJECTION APPARATUS

(75) Inventor: Masami Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/507,274

(22) Filed: Jul. 22, 2009

(65) Prior Publication Data

US 2009/0278881 A1 Nov. 12, 2009

Related U.S. Application Data

(62) Division of application No. 11/471,859, filed on Jun. 21, 2006, now Pat. No. 7,604,341.

(30) Foreign Application Priority Data

Dec. 20, 2005 (JP) ..... 2005-366581

(51) Int. Cl.
*B41J 29/38* (2006.01)

(52) U.S. Cl. ..... 347/9; 347/13; 347/16

(58) Field of Classification Search ..... None
See application file for complete search history.

(56) References Cited

U.S. PATENT DOCUMENTS

| | | | | |
|---|---|---|---|---|
| 5,825,378 | A | 10/1998 | Beauchamp | |
| 6,315,386 | B1 | 11/2001 | Bailey et al. | |
| 2004/0165025 | A1 | 8/2004 | Ishibashi et al. | |
| 2005/0005996 | A1* | 1/2005 | Mizutani | 141/25 |
| 2005/0024464 | A1 | 2/2005 | Takagi | |
| 2005/0128276 | A1 | 6/2005 | Yamada | |
| 2006/0098070 | A1 | 5/2006 | Kumagai | |
| 2008/0070008 | A1 | 3/2008 | Namba et al. | |

FOREIGN PATENT DOCUMENTS

| | | |
|---|---|---|
| JP | 04-044853 | 2/1992 |
| JP | 08-080646 | 3/1996 |
| JP | 11-115270 | 4/1999 |
| JP | 11-170623 | 6/1999 |
| JP | 2005-103884 | 4/2005 |
| JP | 2005-169990 | 6/2005 |

OTHER PUBLICATIONS

Machine translation of JP 08-080646 A.*
Translation of JP 08-080646 A.*

* cited by examiner

*Primary Examiner* — Matthew Luu
*Assistant Examiner* — Justin Seo
(74) *Attorney, Agent, or Firm* — Fildes & Outland, P.C.

(57) ABSTRACT

A liquid droplet ejection apparatus comprising: a conveyor portion that conveys a recording medium to a liquid droplet ejection region by the rotational force of a drive roll; liquid droplet ejection heads that eject liquid droplets onto the recording medium conveyed to the liquid droplet ejection region by the conveyor portion; a feed portion that feeds the recording medium to the conveyor portion at a predetermined feed timing; a detection portion that detects a rotational position of the drive roll; and a control portion that controls the feed timing of the feed portion based on the rotational position that the detection portion has detected, so that when the drive roll reaches a predetermined rotational position, the control portion causes the recording medium to be conveyed to the liquid droplet ejection region and causes the liquid droplet ejection heads to start ejecting the liquid droplets onto the recording medium, is provided.

5 Claims, 13 Drawing Sheets

LIQUID DROPLET EJECTION APPARATUS

CROSS-REFERENCE TO RELATED APPLICATION

This application is a division of U.S. application Ser. No. 11/471,859 filed Jun. 21, 2006, now U.S. Pat. No. 7,604,341, which claims priority under 35 USC 119 from Japanese Patent Application No. 2005-366581, the disclosure of which is incorporated by reference herein.

BACKGROUND

1. Technical Field

The present invention relates to a liquid droplet ejection apparatus that ejects liquid droplets.

2. Related Art

As liquid droplet ejection apparatus, inkjet recording apparatus are known which conduct printing on paper by causing the paper to be attracted to an endless conveyor belt, conveying the paper to the underside of inkjet recording heads, and ejecting ink droplets onto the paper from the inkjet recording heads.

The endless conveyor belt is stretched around a drive roll and a driven roll, and is circulated/driven (rotates) as a result of the drive roll being caused to rotate.

The present invention provides a liquid droplet ejection apparatus that can eliminate variations in image quality arising between the pages of a recording medium, even when shifts in the landing positions of ink droplets resulting from variations in the conveyance speed of a conveyor belt in a recording apparatus arise.

SUMMARY

According to an aspect of the invention, there is provided a liquid droplet ejection apparatus including a conveyor portion that conveys a recording medium to a liquid droplet ejection region by the rotational force of a drive roll that rotates/drives; liquid droplet ejection heads that record an image by ejecting liquid droplets onto the recording medium conveyed to the liquid droplet ejection region by the conveyor portion; a feed portion that feeds the recording medium to the conveyor portion at a predetermined feed timing; a detection portion that detects a rotational position of the drive roll; and a control portion that controls the feed timing of the feed portion on the basis of the rotational position that the detection portion has detected, so that when the drive roll reaches a predetermined rotational position, the control portion causes the recording medium to be conveyed to the liquid droplet ejection region and causes the liquid droplet ejection heads to start ejecting the liquid droplets onto the recording medium.

BRIEF DESCRIPTION OF THE DRAWINGS

Exemplary embodiments of the present invention will be described in detail based on the following figures, wherein.

DETAILED DESCRIPTION

Exemplary embodiments of a liquid droplet ejection apparatus pertaining to the present invention will be described below on the basis of the drawings.

First, an inkjet recording apparatus that ejects ink droplets to record an image will be described as a liquid droplet ejection apparatus that ejects liquid droplets.

Figure 1:
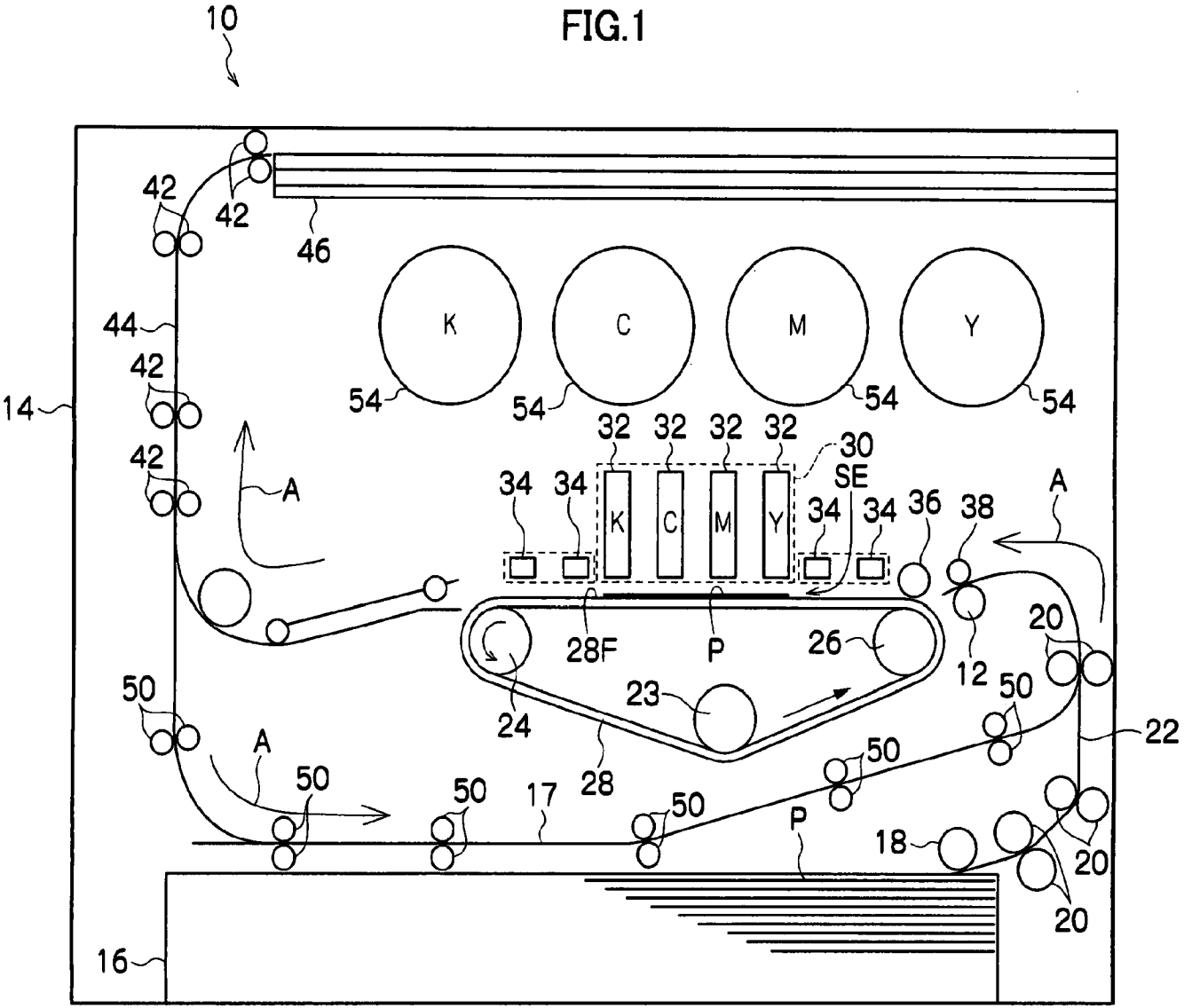
FIG. 1 is a diagram showing the overall configuration of an inkjet recording apparatus pertaining to a first exemplary embodiment of the present invention.

FIG. 1 shows the overall configuration of an inkjet recording apparatus 10 pertaining to a first exemplary embodiment of the present invention.

The inkjet recording apparatus 10 includes a casing 14 in whose lower portion a paper tray 16, in which sheets of paper (recording medium) P are stacked, is disposed. The sheets of paper P stacked in the paper tray 16 are picked up one sheet at a time by a feed roll 18. The picked-up paper P is conveyed downstream (direction A in FIG. 1; this direction will be called "the conveyance direction A" below) by plural conveyance roll pairs 20 that configure a predetermined conveyance path 22.

An endless conveyor belt 28 is disposed above the paper tray 16. The conveyor belt 28 is stretched around a drive roll 24, which rotates/drives in one direction (counter-clockwise direction in FIG. 1), a driven roll 26, and a tension roll 23. The tension roll 23 presses the conveyor belt 28 in the direction from the inner periphery of the conveyor belt 28 to the outer periphery of the conveyor belt 28 (downward in FIG. 1), whereby predetermined tension is imparted to the conveyor belt 28. The conveyor belt 28 rotates in one direction (counter-clockwise direction in FIG. 1) due to the rotational force of the drive roll 24.

The circumferential length of the drive roll 24 is 80 mm, for example, and the length of the conveyor belt 28 is 690 mm, for example, which is a length that can cross-feed three sheets of A4-size paper.

A recording head array 30 is disposed above the conveyor belt 28, and the recording head array 30 faces a flat portion 28F of the conveyor belt 28. This region, where the recording head array 30 faces the flat portion 28F of the conveyor belt 28, serves as an ink droplet ejection region (liquid droplet ejection region) SE where ink droplets (liquid droplets) are ejected from the recording head array 30. The paper P conveyed on the conveyance path 22 is retained and conveyed by the conveyor belt 28 to the ink droplet ejection region SE, where ink droplets corresponding to image information are ejected onto the paper P from the recording head array 30 and adhere to the paper P in a state where the paper P faces the recording head array 30.

In the present exemplary embodiment, the recording head array 30 is configured as a long recording head array such that its effective recording region is equal to or greater than the width of the paper P (the length of the paper P in the direction orthogonal to the conveyance direction A). The recording head array 30 includes four inkjet recording heads (liquid droplet ejection heads) 32 that correspond to the four colors of yellow (Y), magenta (M), cyan (C) and black (K) and are disposed along the conveyance direction, whereby the recording head array 30 is capable of recording a full-color image.

A control unit (controller) 62 that drives/controls the inkjet recording heads 32 is connected to each of the inkjet recording heads 32. The control unit 62 is configured to determine ink ejection ports (nozzles) that are to be used in accordance with the image information, determine, as will be described later, ejection timings at which the inkjet recording heads 32 eject the ink droplets, and send drive signals to the inkjet recording heads 32 (see FIG. 3).

A charge roll 36, to which a power supply is connected, is disposed upstream of the recording head array 30. The charge roll 36 follows the rotation of the driven roll 26 while nipping the conveyor belt 28 and the paper P between itself and the driven roll 26, and is configured to be movable between a pressing position where the charge roll 36 presses the paper P against the conveyor belt 28 and a separation position where the charge roll 36 is separated from the conveyor belt 28. Because a predetermined potential difference arises between the charge roll 36 and the grounded driven roll 26 in the pressing position, the charge roll 36 imparts electrical charge to the paper P to cause the paper P to be electrostatically attracted to the conveyor belt 28.

A registration roll 12, which serves as a conveyance roll (feed unit) that feeds the paper P to the conveyor belt 28, and a driven roll 38, which is disposed facing the registration roll 12, are disposed upstream of the charge roll 36.

The registration roll 12 includes a skew correcting function that corrects skew of the paper P by aligning the position of the leading end of the paper P. In this skew correcting function, the leading end of the paper P, from one end portion to the other end portion in the width direction (direction orthogonal to the conveyance direction A), is introduced to a nip portion formed between the registration roll 12 and the driven roll 38, and when the leading end of the paper P has become orthogonal to the conveyance direction A, the registration roll 12 is driven to convey the paper P. Thus, skew of the paper P is corrected.

A separation plate (not shown) is disposed downstream of the recording head array 30. The separation plate separates the paper P from the conveyor belt 28. The separated paper P is conveyed by plural discharge roll pairs 42, which configure a discharge path 44 downstream of the separation plate, and discharged to a paper discharge tray 46 disposed in the upper portion of the casing 14.

An inversion path 17 configured by plural inversion-use roll pairs 50 is disposed between the paper tray 16 and the conveyor belt 28. When an image has been recorded on one side of the paper P, the paper P is inverted and retained on the conveyor belt 28, so that an image can be easily recorded on the other side of the paper P.

Ink tanks 54 that respectively store inks of the aforementioned four colors are disposed between the conveyor belt 28 and the paper discharge tray 46. The inks inside the ink tanks 54 are supplied to the recording head array 30 by unillustrated ink supply pipes. Various types of known inks can be used as the inks, such as water-based inks, oil-based inks, and solvent inks.

Figure 2:
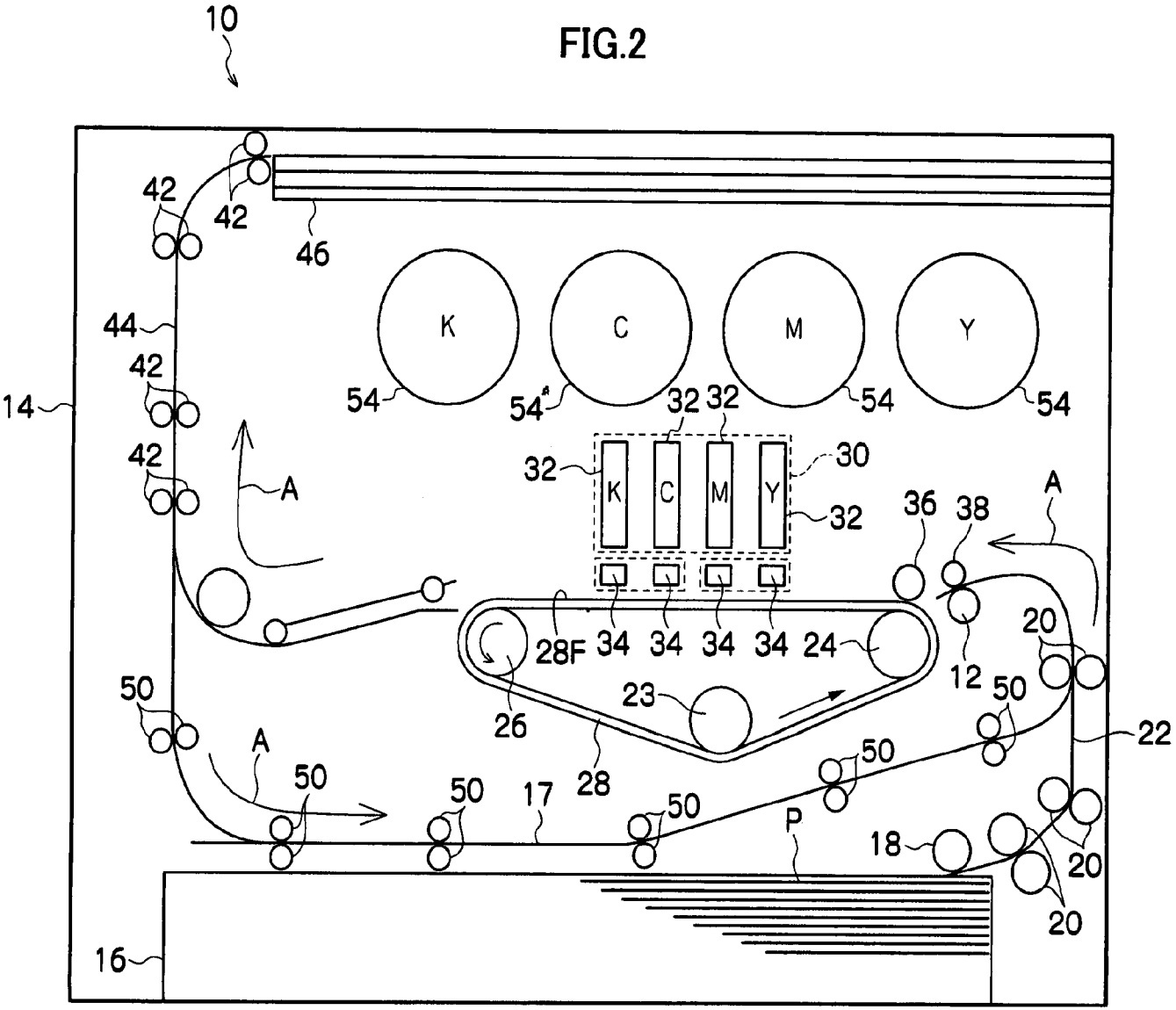
FIG. 2 is a diagram showing maintenance in the inkjet recording apparatus pertaining to the first exemplary embodiment of the present invention.

A total of four maintenance units 34 corresponding to the inkjet recording heads 32 are disposed on both sides of the recording head array 30. As shown in FIG. 2, when maintenance is to be conducted with respect to the inkjet recording heads 32, the recording head array 30 is moved upward and the maintenance units 34 move into a gap formed thereby between the recording head array 30 and the conveyor belt 28. Then, the maintenance units 34 conduct predetermined maintenance (vacuuming, dummy jetting, wiping, capping, etc.) in a state where the maintenance units 34 face nozzle surfaces of the inkjet recording heads 32.

Next, a configuration that controls ejection timings at which the inkjet recording heads 32 eject the ink droplets will be described.

Figure 3:
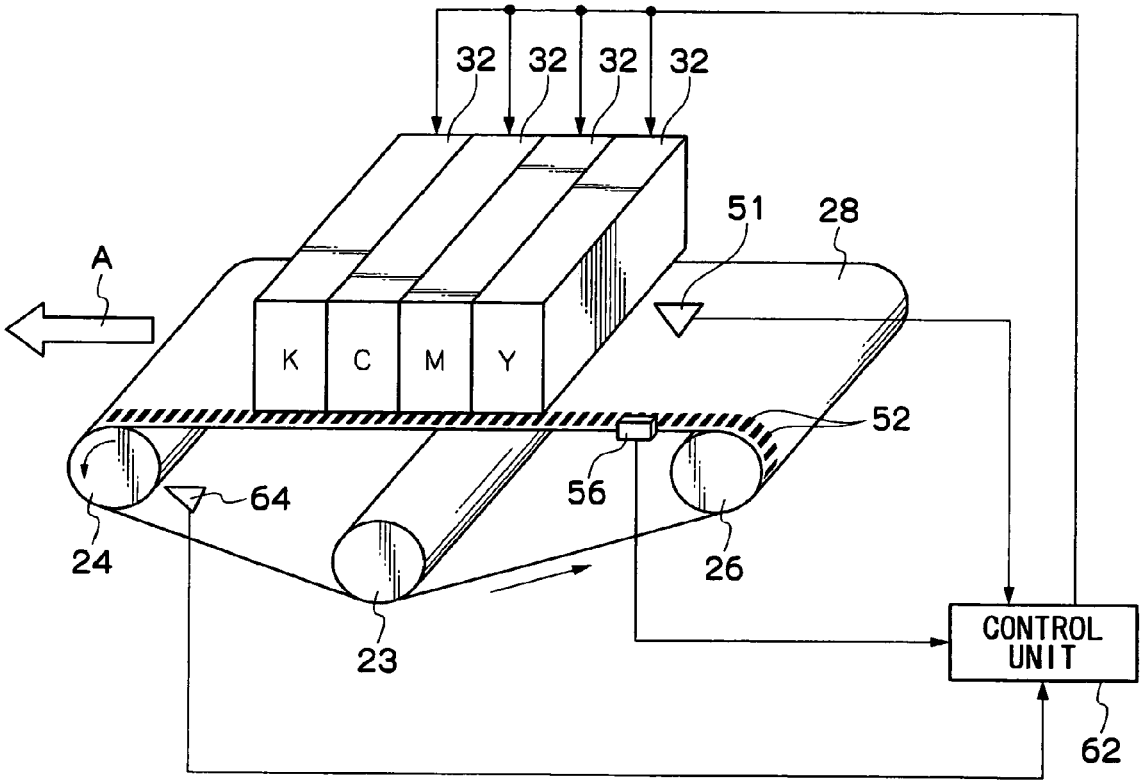
FIG. 3 is a diagram showing the configuration of a conveyor belt and its vicinity pertaining to the first exemplary embodiment of the present invention.

As shown in FIG. 3, an entrance sensor 51 that detects the leading end of the paper P is disposed above the conveyor belt 28 at a position upstream of the inkjet recording heads 32.

The control unit 62 is connected to the entrance sensor 51. When the entrance sensor 51 detects the leading end of the paper P, the entrance sensor 51 inputs a detection signal to the control unit 62.

Further, ejection timing-use marks 52, which are used in order to control the ejection timings, are plurally disposed along the rotational direction (circumferential direction) on one end portion (position where the paper P is not placed) of the conveyor belt 28 in the rotational axis direction (direction orthogonal to the circumferential direction) of the conveyor belt 28. The ejection timing-use marks 52 are added at equidistant intervals, and these intervals are the same as the resolution of the inkjet recording apparatus 10 in the conveyance direction A. Thus, the moving amount of the conveyor belt 28 can be detected with a precision equal to the resolution.

It will be noted that the intervals between the ejection timing-use marks 52 may be several times the resolution of the inkjet recording apparatus 10 in the conveyance direction A, or the intervals between the ejection timing-use marks 52 may be added such that they are coarser than the resolution.

Further, the ejection timing-use marks 52 may be configured such that, rather than being disposed in one row, they are disposed in multiple rows. In this case, for example, the intervals between the ejection timing-use marks 52 disposed in single rows may be an N multiple (where N is an integer of 2 or greater) of the resolution, and N rows of the ejection timing-use marks 52 may be disposed on the conveyor belt 28 parallel to each other and shifted one pixel in the conveyance direction. Further, slits may be disposed in the conveyor belt 28 instead of the ejection timing-use marks 52.

A reading sensor 56 that reads the ejection timing-use marks 52 is disposed on one end portion of the conveyor belt 28 in the rotational axis direction at a position upstream of the inkjet recording heads 32. The reading sensor 56 is configured to detect the ejection timing-use marks 52 each time the ejection timing-use marks 52 pass a predetermined position when the conveyor belt 28 rotates.

The control unit 62 is connected to the reading sensor 56. Each time the reading sensor 56 detects the ejection timing-use marks 52, the reading sensor 56 inputs a detection signal to the control unit 62. Each of the detection signals that are inputted to the control unit 62 each time the ejection timing-use marks 52 pass the predetermined position configures one clock of a printing clock (reference clock) serving as an ejection timing reference. The control unit 62 counts the number of clocks (number of ejection timing-use marks 52 that have passed the predetermined position), whereby the moving amount of the conveyor belt 28 is detected.

According to the above configuration, first, the paper P fed on the basis of a printing command (image recording command) from a user or the like is introduced to the conveyor belt 28. Then, when the leading end of the paper P passes below the entrance sensor 51, the entrance sensor 51 detects the leading end of the paper P and inputs a detection signal to the control unit 62 (see FIG. 5). When this detection signal is inputted to the control unit 62, the control unit 62 counts, using the detection signal as a starting point, the number of clocks (number of ejection timing-use marks 52 that have passed the predetermined position) of the printing clock inputted from the reading sensor 56.

The distances from the entrance sensor 51 to the nozzles of each of the inkjet recording heads 32 (see L1 to L4 in FIG. 5) are regulated by predetermined design values. The timing at which the paper P is conveyed directly below the nozzles in the ink droplet ejection region SE is understood by counting the predetermined number of clocks of the printing clock. When there are differences, with respect to set values, in the distances from the entrance sensor 51 to the nozzles of each of the inkjet recording heads 32 due to manufacturing variation, then the control unit 62 conducts correction control by increasing/decreasing the predetermined number of clocks.

Figure 5:
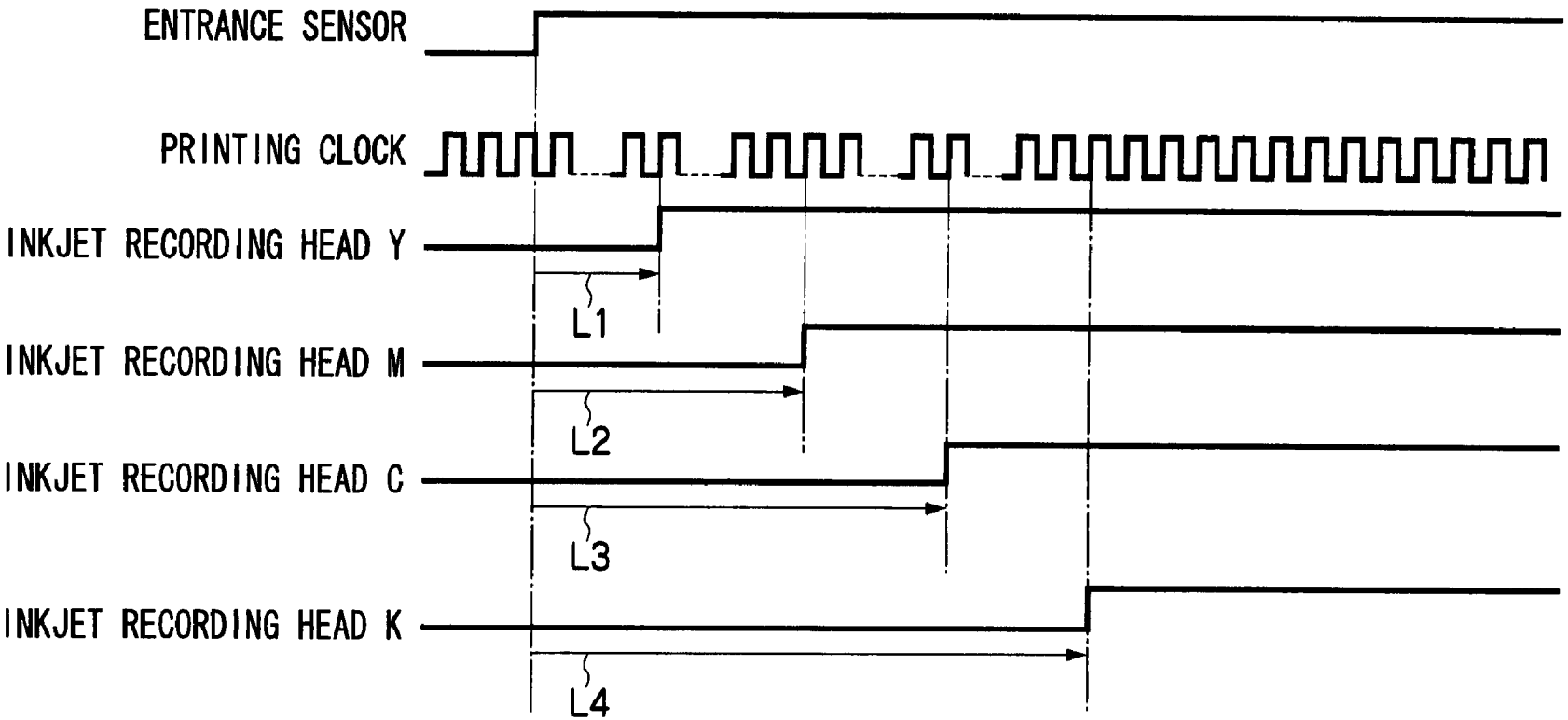
FIG. 5 is a diagram showing ejection timings of inkjet recording heads pertaining to the first exemplary embodiment of the present invention.

In FIG. 5, L1 represents the distance from the entrance sensor 51 to the nozzles of the yellow inkjet recording head 32, L2 represents the distance from the entrance sensor 51 to the nozzles of the magenta inkjet recording head 32, L3 represents the distance from the entrance sensor 51 to the nozzles of the cyan inkjet recording head 32, and L4 represents the distance from the entrance sensor 51 to the nozzles of the black inkjet recording head 32.

As shown in FIG. 5, the control unit 62 generates ejection timings and sends a drive signal to each of the inkjet recording heads 32 by counting the predetermined number of clocks of the printing clock. Thus, each of the inkjet recording heads 32 starts ejecting the ink droplets, and an image corresponding to image information is recorded on the paper P.

Figure 4:
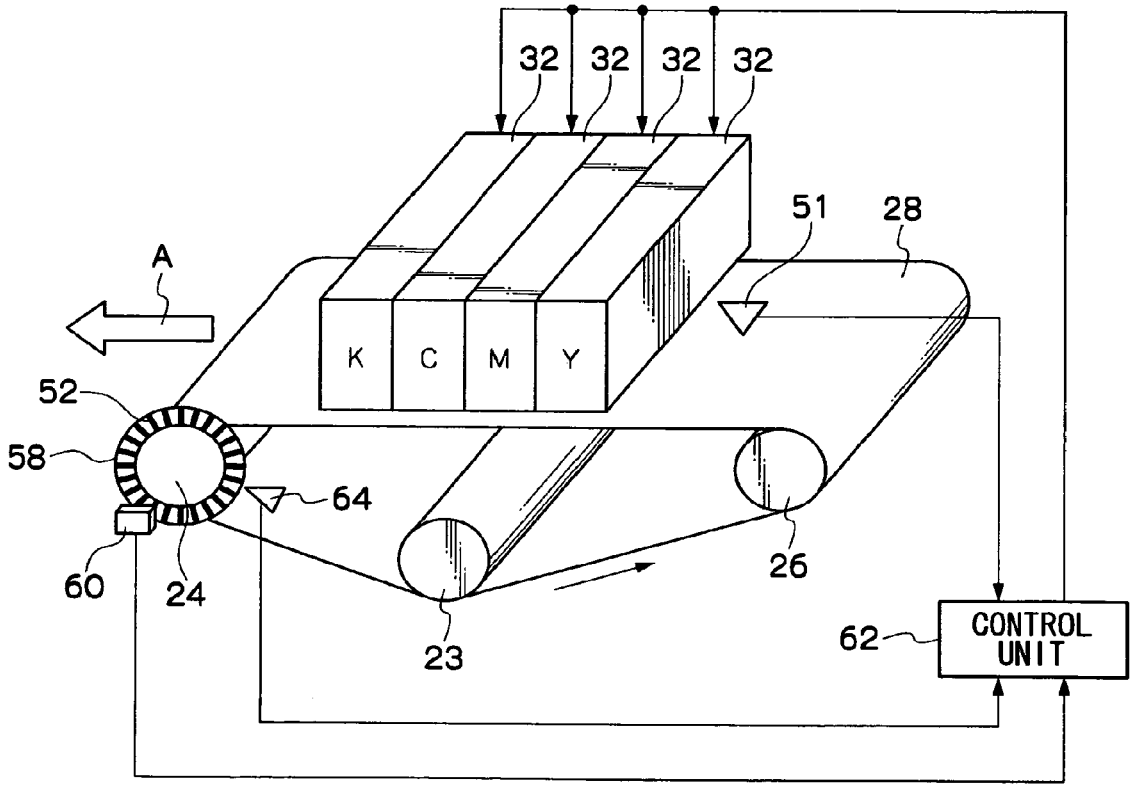
FIG. 4 is a diagram showing a modification where ejection timing-use marks pertaining to the first exemplary embodiment of the present invention are disposed on a drive roll.

Further, as shown in FIG. 4, the inkjet recording apparatus 10 may also be configured such that, instead of the ejection timing-use marks 52 being disposed on the conveyor belt 28, an encoder film 58, to which the ejection timing-use marks 52 have been added, is disposed on one end portion of the drive roll 24 in the rotational axis direction. In this configuration, the encoder film 58 is disposed coaxially with the drive roll 24 and rotates integrally with the drive roll 24. Similar to the configuration where the ejection timing-use marks 52 are disposed on the conveyor belt 28, the ejection timing-use marks 52 here are added to the encoder film 58 at equidistant intervals along the circumferential direction of the drive roll 24, and these intervals are the same as the resolution of the inkjet recording apparatus 10 in the conveyance direction.

Further, an encoder sensor 60 that reads the ejection timing-use marks 52 is disposed on one end portion of the drive roll 24 in the rotational axis direction. The control unit 62 is connected to the encoder sensor 60. Each time the encoder sensor 60 detects the ejection timing-use marks 52, the encoder sensor 60 inputs a detection signal to the control unit 62.

According to this configuration, the control unit 62 can control, in the same manner as when the ejection timing-use marks 52 are disposed on the conveyor belt 28, the ejection timings at which the inkjet recording heads 32 eject the ink droplets.

Figure 6:
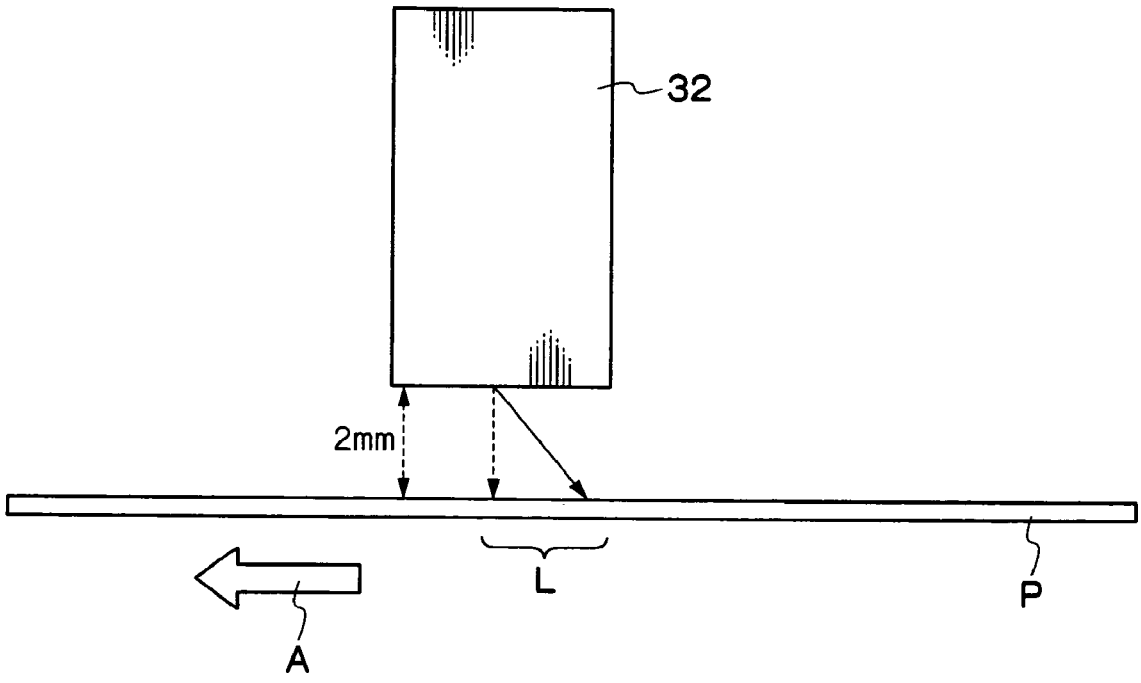
FIG. 6 is a diagram showing a shift in the position where ink lands in the inkjet recording apparatus pertaining to the first exemplary embodiment of the present invention.

Incidentally, in the inkjet recording apparatus 10 pertaining to the present exemplary embodiment, the belt conveyance speed of the conveyor belt 28 becomes 762 mm/sec when the recording resolution is 600 dpi and the inkjet recording heads 32 are driven at a head drive frequency of 18 KHz. When the inkjet recording heads 32 eject the ink droplets onto the paper P at a speed of 8 m/sec and the distance between the underside of the inkjet recording heads 32 and the surface of the paper P is 2 mm, the positions where the ink droplets actually land on the paper P after having been ejected become shifted 190 μm along the conveyance direction A (see L in FIG. 6).

The conveyance speed of the conveyor belt 28 varies when the drive roll 24 becomes eccentric. When a fluctuation of ±5%, for example, is present in the conveyance speed of the conveyor belt 28, the landing positions of the ink droplets vary in the range of 10 μm. In this case, the range of variation in the conveyance speed of the conveyor belt 28 becomes 20 μm and shifts a maximum of 20 μm. Due to this shift, effects appear in image quality such as secondary colors.

Because the way in which variations in the speed of the conveyor belt 28 arise when the inkjet recording heads 32 eject the ink droplets differs per page of the paper P, shifts in the landing positions of the ink droplets become varied per page, and variations in image quality arise between the pages of the paper P.

Here, a configuration will be described which eliminates, by controlling the feed timing at which the paper P is fed to the conveyor belt 28, variations in image quality between the pages of the paper P arising due to eccentricity of the drive roll 24.

A home mark (not shown) is added to one place on the outer peripheral surface of the drive roll 24. As shown in FIG. 3, a home sensor 64 that reads the home mark (not shown) is disposed on the outer periphery of the drive roll 24.

Figure 7:
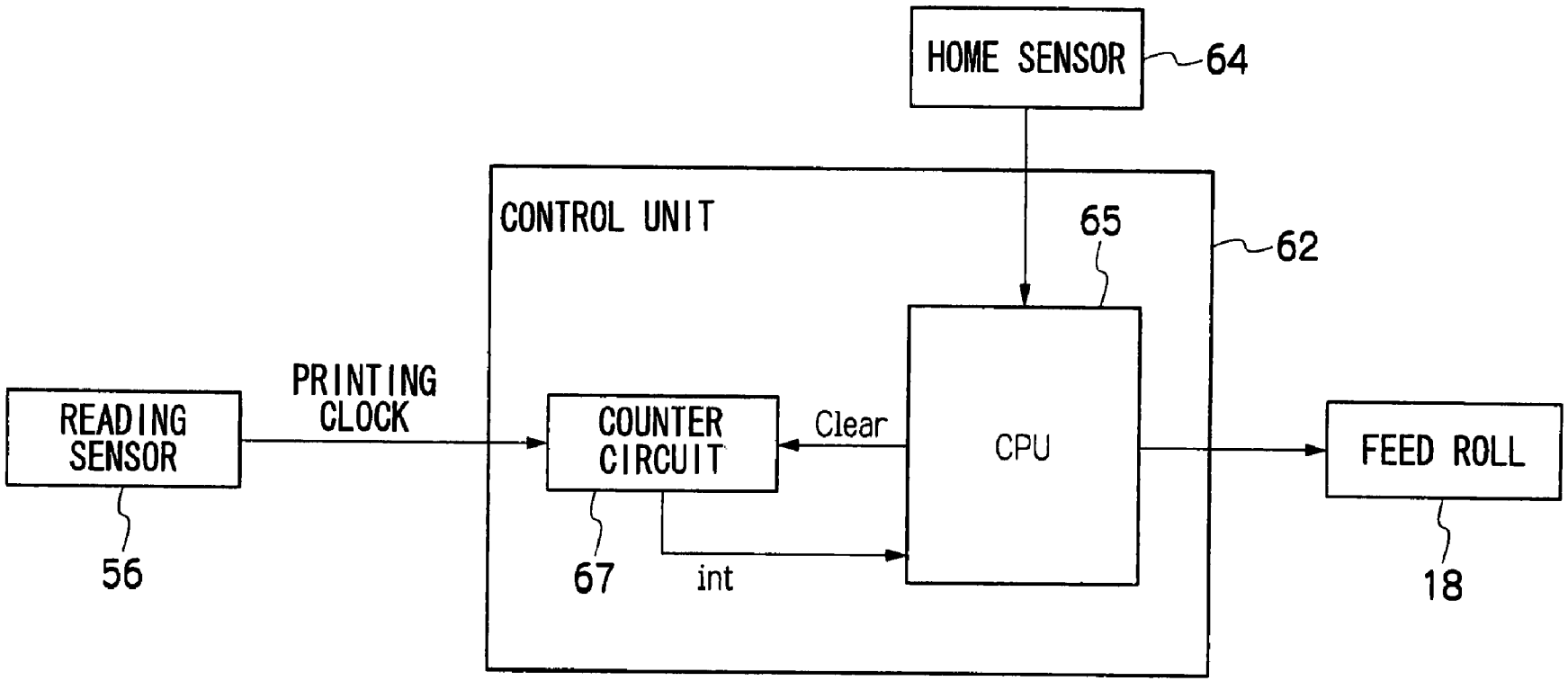
FIG. 7 is a diagram showing a control system in the inkjet recording apparatus pertaining to the first exemplary embodiment of the present invention.

As shown in FIG. 7, the home sensor 64 is connected to a CPU 65 of the control unit 62. When the home sensor 64 detects the home mark, the home sensor 64 inputs a detection signal to the CPU 65. Thus, the fact that the drive roll 24 has reached a predetermined rotational position (home position) is detected. Further, when the home sensor 64 inputs this detection signal to the CPU 65, the CPU 65 inputs a clear signal to a counter circuit 67 in the control unit 62 that counts the printing clock, and the number of clocks of the printing clock counted by the counter circuit 67 is reset to 0.

In the present exemplary embodiment, as will be described below, the control unit 62 controls the feed timing at which the paper P is fed from the paper tray 16 such that, when the home sensor 64 detects the home mark, the paper P is fed to the conveyor belt 28 in synchronization with the detection signal inputted to the control unit 62. In the present exemplary embodiment, as shown in FIG. 8, the conveyance speed of the drive roll 24 varies as repeatedly becoming high or low with respect to a set value coinciding with the timing at which the home sensor 64 detects the home mark, that is, the timing at which the drive roll 24 completes one rotation.

First, the control unit 62 identifies the amount of time for feeding the paper P from the paper tray 16 to the conveyor belt 28 and the amount of time required from when the home sensor 64 detects the home mark to when the home sensor 64 next detects the home mark.

Figure 8:
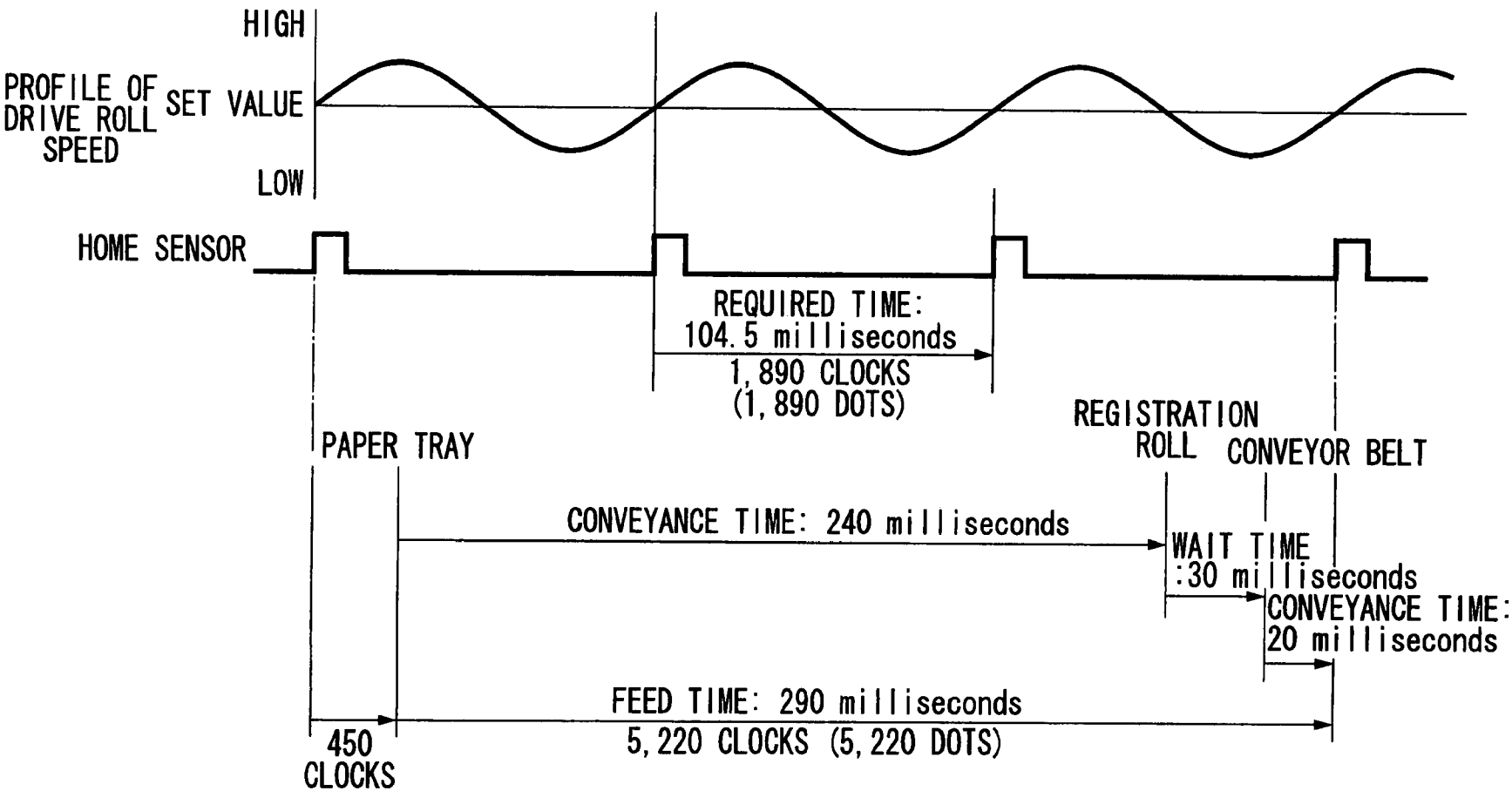
FIG. 8 is a diagram showing an operation where paper is fed to the conveyor belt in synchronization with a detection signal inputted from a home sensor to a control unit in the inkjet recording apparatus pertaining to the first exemplary embodiment of the present invention.

In the present exemplary embodiment, as shown in FIG. 8, for example, the amount of time for conveying the paper P from the paper tray 16 to the registration roll 12 is set to 240 milliseconds, the amount of wait time for correcting skew of the paper P with the registration roll 12 is set to 30 milliseconds, and the amount of time for conveying the paper P from the registration roll 12 to the conveyor belt 28 is set to 20 milliseconds. Consequently, the amount of time for feeding the paper P from the paper tray 16 to the conveyor belt 28 becomes 290 milliseconds. This feeding time of 290 milliseconds corresponds to 5,220 counts (5,220 dots) when converted to the printing clock.

The amount of time required from when the home sensor 64 detects the home mark to when the home sensor 64 next detects the home mark is 104.5 milliseconds, for example. This required time of 104.5 milliseconds corresponds to 1,890 counts (1,890 dots) when converted to the printing clock.

Consequently, by adding 450 counts, the feeding time of 5,220 counts matches a counted number of 5,670 counts obtained by multiplying the required time of 1,890 counts by three.

Thus, in the present exemplary embodiment, the control unit 62 is configured such an interruption (int signal) is generated in the CPU 65 at the point in time when 450 is counted from the point in time when the detection signal is inputted from the home sensor 64. Thus, when the interruption is generated at the point in time when the driving of the conveyor belt 28 is started and the inkjet recording heads 32 become ready to record an image, the CPU 65 sends a drive signal to the feed roll 18 to cause the feed roll 18 to start supplying the paper P from the paper tray 16. Thereafter, due to the interruption that is generated after every three times the detection signal from the home sensor 64 is inputted, the CPU 65 sends the drive signal to the feed roll 18 to cause the feed roll 18 to start supplying the paper P from the paper tray 16.

Thus, because the detection timing at which the home sensor 64 detects the home mark coincides with the placement timing at which the paper P is placed on the conveyor belt 28, the paper P is placed on the conveyor belt 28 in synchronization with the detection signal inputted to the control unit 62 when the home sensor 64 detects the home mark.

The paper P placed on the conveyor belt 28 is conveyed by the conveyor belt 28 to the ink droplet ejection region SE, where ink droplets are ejected from the inkjet recording heads 32 onto the paper P, and an image is recorded. Thus, the ejection of the ink droplets is started when the drive roll 24 has reached the predetermined rotational position.

In this manner, because the ejection of the ink droplets is started when the drive roll 24 has reached the predetermined rotational position, shifts in the positions of the liquid droplets landing on the paper P always become constant, even when the speed at which the paper P is conveyed varies at the time of ink droplet ejection. For this reason, variations in image quality arising between the pages of the paper P can be eliminated.

In the present exemplary embodiment, the control unit 62 is configured to control the feed timing at which the registration roll 12 feeds the paper P to the conveyor belt 28 by controlling the feed timing at which the paper P are fed from the paper tray 16, but the control unit 62 may also be configured to control the feed timing at which the registration roll 12 feeds the paper P to the conveyor belt 28 by calculating the waiting time in which the conveyance of the paper P is temporarily stopped at another place in the conveyance path 22 (e.g., the registration roll 12).

Figure 9A:
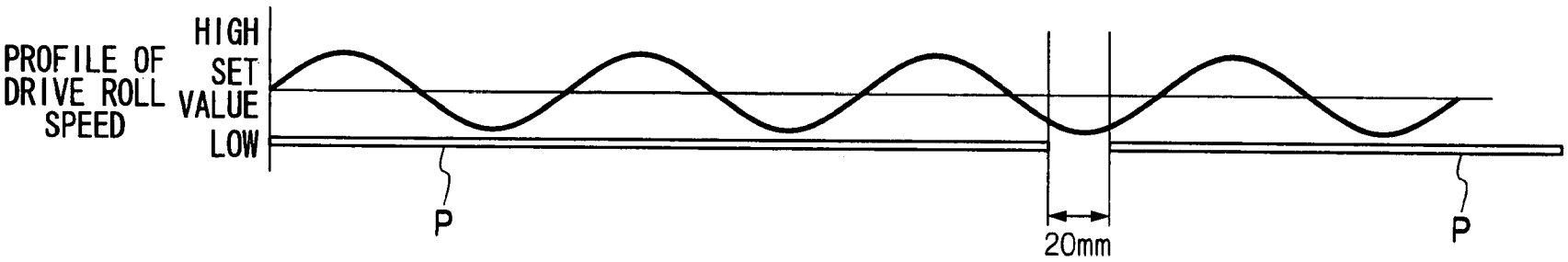
FIG. 9A is a diagram showing the relationship between the paper and variations in the speed of the drive roll in the case of a high speed mode of image recording pertaining to the first exemplary embodiment of the present invention.

Further, in the present exemplary embodiment, the inkjet recording apparatus 10 is configured such that selection between a high speed mode and a high image quality mode for the image recording mode is possible. When the high speed mode is selected, as shown in FIG. 9A, the image recording speed is increased by minimizing the interval between the sheets of the paper P (e.g., 20 mm) and recording images.

When image-recording plural sheets of the same manuscript in the high speed mode, the variations in the conveyance speed at the time of image recording differ per sheet of paper depending on each area on the paper P, and image-recording is done in areas where the variations in the conveyance speed are different.

Figure 9B:
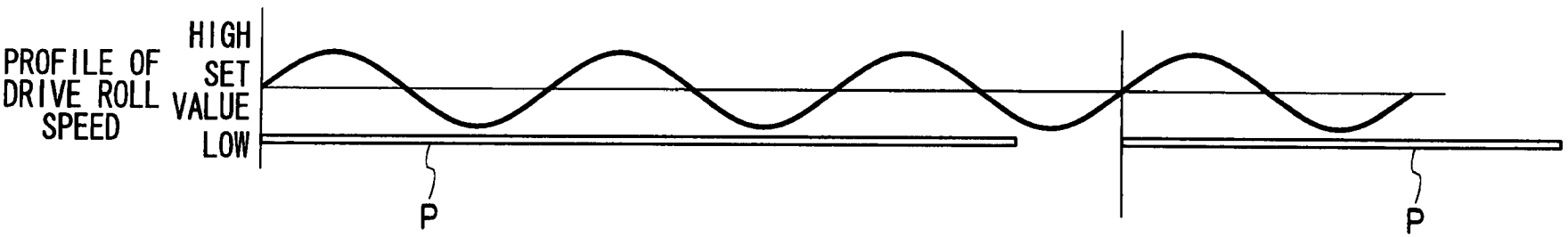
FIG. 9B is a diagram showing the relationship between the paper and variations in the speed of the drive roll in the case of a high image quality mode of image recording pertaining to the first exemplary embodiment of the present invention.

When the high image quality mode is selected, the paper P is placed on the conveyor belt 28 in synchronization with the detection signal inputted to the control unit 62 when the home sensor 64 detects the home mark, as described above. Thus, as shown in FIG. 9B, variations in the speed of the drive roll 24 arising in each area on the paper P occur equally per page. Consequently, because the variations in the speed per page become substantially uniform, shifts in the landing positions of the ink droplets can also be made the same per page, and the printing quality between pages can be made uniform.

Next, a second exemplary embodiment of the present invention will be described.

An inkjet recording apparatus 100 pertaining to the second exemplary embodiment ejects ink droplets to record an image on continuous paper that is formed long.

Figure 10:
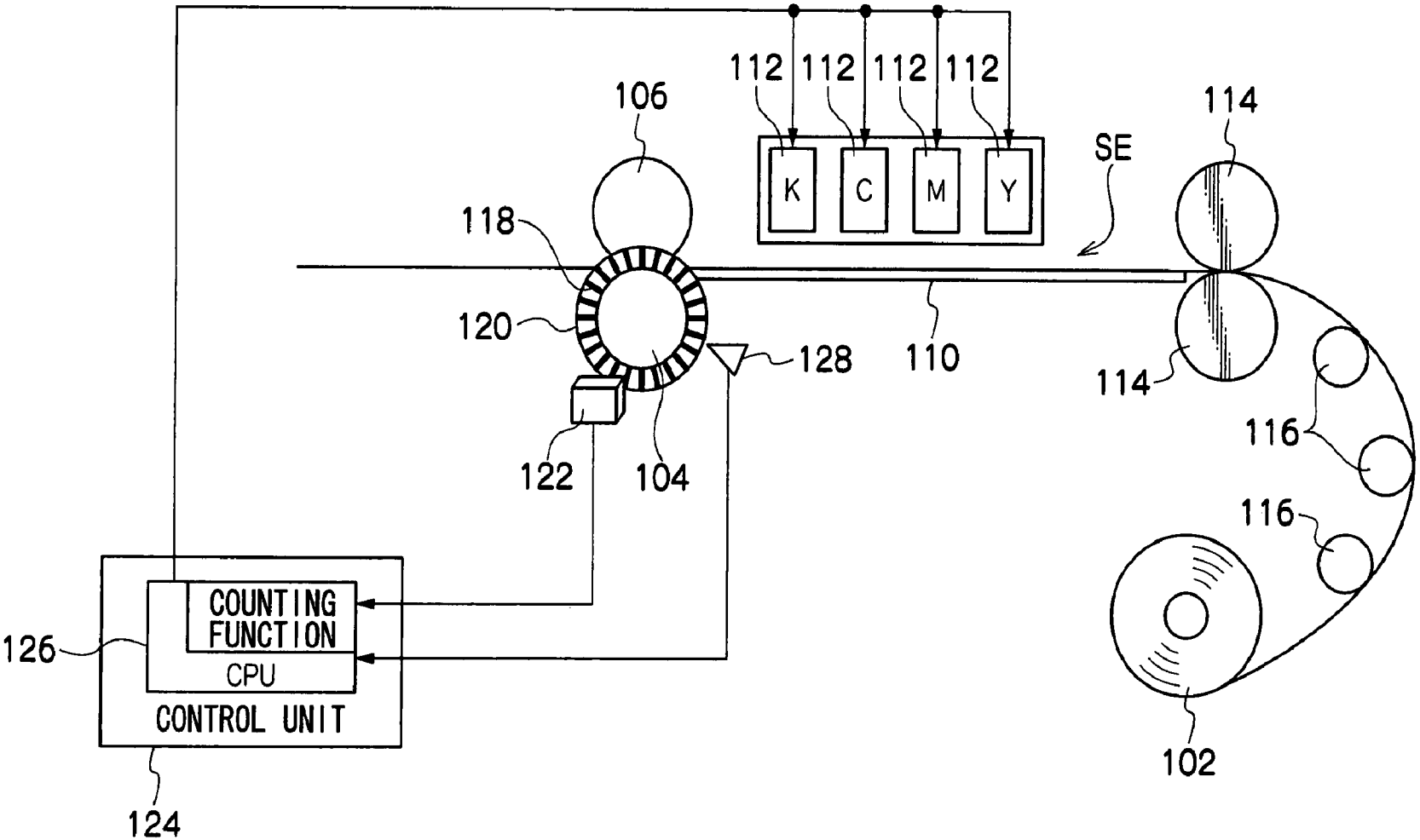
FIG. 10 is a diagram showing the overall configuration of an inkjet recording apparatus pertaining to a second exemplary embodiment of the present invention.

As shown in FIG. 10, the inkjet recording apparatus 100 is disposed with roll paper 102 in the form of continuous paper. The roll paper 102 includes paper that is formed long and wound in a roll. One end of the roll paper 102 is pulled out.

The pulled-out one end of the roll paper 102 is nipped between a drive roll 104 rotates/drives in one direction (counter-clockwise direction in FIG. 10) and a driven roll 106 that is disposed facing the drive roll 104. The roll paper 102 is conveyed downstream (direction A in FIG. 10; this direction will be referred to as "the conveyance direction A" below) by the rotational force of the drive roll 104.

A recording head array 108 is disposed upstream of the drive roll 104 and faces a platen 110. This region, in which the recording head array 108 faces the platen 110, serves as an ink droplet ejection region (liquid droplet ejection region) SE where ink droplets (liquid droplets) are ejected onto the roll paper 102 from the recording head array 108. The roll paper 102 is conveyed on a conveyance path and reaches the ink droplet ejection region SE, where ink droplets corresponding to image information are ejected onto the roll paper 102 from the recording head array 108 and adhere to the roll paper 102 in a state where the roll paper 102 faces the recording head array 108.

The recording head array 108 is configured as a long recording head array such that its effective recording region is equal to or greater than the width of the roll paper 102 (the length of the roll paper 102 in the direction orthogonal to the conveyance direction A). The recording head array 108 includes four inkjet recording heads (liquid droplet ejection heads) 112 that correspond to the four colors of yellow (Y), magenta (M), cyan (C) and black (K) and are disposed along the conveyance direction A, whereby the recording head array 108 is capable of recording a full-color image.

A control unit (controller) 124 that drives/controls the inkjet recording heads 112 is connected to each of the inkjet recording heads 112. The control unit 124 is disposed with a CPU 126 that is configured to determine ink ejection ports (nozzles) that are to be used in accordance with the image information, determine, as will be described later, ejection timings at which the inkjet recording heads 112 eject the ink droplets, and send drive signals to the inkjet recording heads 112.

A pair of conveyance rolls 114 that convey the roll paper 102 is disposed upstream of the recording head array 108. Driven rolls 116 that retain the roll paper 102 in a rounded manner and impart predetermined tension to the roll paper 102 are disposed upstream of the pair of conveyance rolls 114.

Encoder film 120, to which ejection timing-use marks 118 have been plurally added, is disposed on one end portion of the drive roll 104 in the rotational axis direction. The encoder film 120 is disposed coaxially with the drive roll 104 and rotates integrally with the drive roll 104. Ejection timing-use marks 118 are added to the encoder film 120 at equidistant intervals along the circumferential direction of the drive roll 104. The intervals are the same as the resolution of the inkjet recording apparatus 100 in the conveyance direction A. Thus, the moving amount of the roll paper 102 can be detected with a precision equal to the resolution.

It will be noted that the intervals between the ejection timing-use marks 118 may be several times the resolution of the inkjet recording apparatus 100 in the conveyance direction A, or the intervals between the ejection timing-use marks 118 may be coarser than the resolution.

An encoder sensor 122 that reads the ejection timing-use marks 118 is disposed on one end portion of the drive roll 104 in the rotational axis direction. The encoder sensor 122 is configured to detect the ejection timing-use marks 118 each time the ejection timing-use marks 118 pass a predetermined position when the drive roll 104 rotates.

The CPU 126 of the control unit 124 is connected to the encoder sensor 122. Each time the encoder sensor 122 detects the ejection timing-use marks 118, the encoder sensor 122 inputs a detection signal to the CPU 126. Each of the detection signals that are inputted to the control unit 126 each time the ejection timing-use marks 118 pass the predetermined position configures one clock of a printing clock (reference clock) serving as an ejection timing reference. The control unit 124 counts the number of clocks (number of ejection timing-use marks 118 that have passed the predetermined position), whereby the moving amount of the roll paper 102 is detected.

Further, a home mark (not shown) is added to one place on the outer peripheral surface of the drive roll 104. A home sensor 128 that reads the home mark (not shown) is disposed on the outer periphery of the drive roll 24.

The home sensor 128 is connected to the CPU 126 of the control unit 124. When the home sensor 128 detects the home mark, the home sensor 128 inputs a detection signal to the CPU 126. Thus, the fact that the drive roll 104 has reached a predetermined rotational position (home position) is detected.

Figure 11:
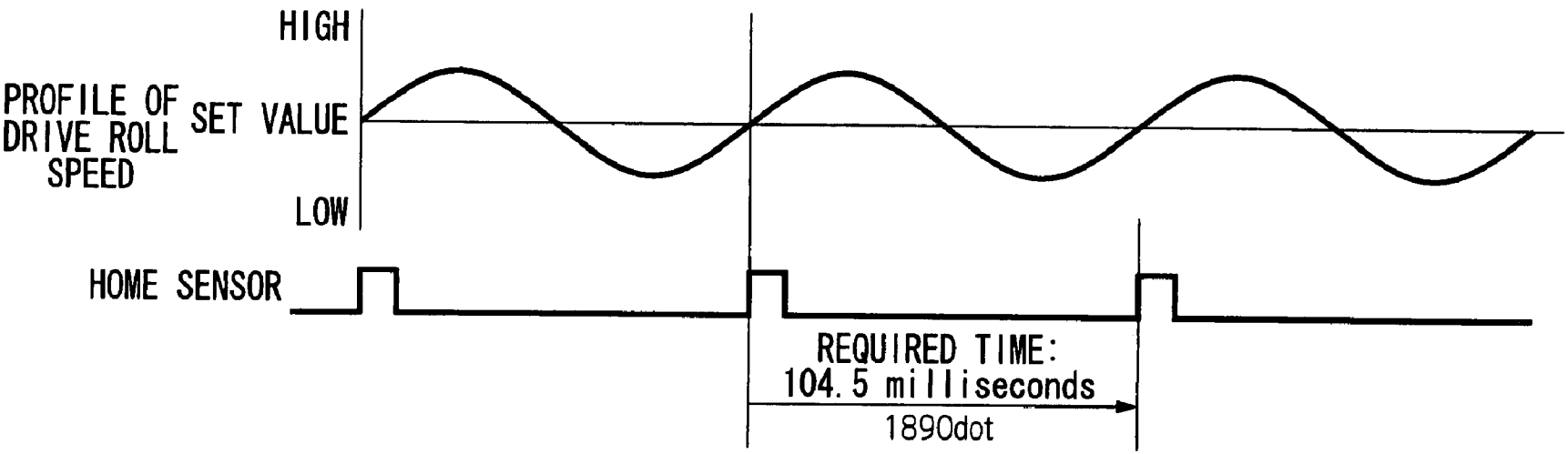
FIG. 11 is a diagram showing the relationship between the timing when a home sensor detects a home mark and variations in the speed of a drive roll in the inkjet recording apparatus pertaining to the second exemplary embodiment of the present invention.

In the present exemplary embodiment, as will be described below, the control unit 124 controls the timing at which the liquid droplet ejection heads 112 start ejecting the ink droplets such that the ejection of the ink droplets is started in synchronization with the detection signal inputted to the CPU 126 when the home sensor 128 detects the home mark. In the present exemplary embodiment, as shown in FIG. 11, the conveyance speed of the drive roll 24 varies as repeatedly becoming high or low with respect to a set value coinciding with the timing at which the home sensor 128 detects the home mark, that is, the timing at which the drive roll 104 completes one rotation.

When the CPU 126 of the control unit 124 receives a printing command (image recording command) from a user or the like, the CPU 126 sends a drive signal to the yellow inkjet recording head 112 to cause the yellow inkjet recording head 112 to start ejecting the ink droplets in synchronization with the detection signal inputted from the home sensor 128.

The control unit 124 counts, using the point in time when the yellow inkjet recording head 112 starts ejecting the ink droplets as a starting point, the number of clocks (number of ejection timing-use marks 118 that have passed the predetermined position) of the printing clock inputted from the encoder sensor 122.

The distances from the nozzles of the yellow inkjet recording head 112 to the nozzles of each of the other inkjet recording heads 112 (see L5 to L7 in FIG. 12) are regulated by predetermined designs value. The control unit 124 counts the number of clocks of the printing clock, whereby the timing at which the roll paper 102 is conveyed directly below the nozzles in the ink droplet ejection region SE is understood. When there are differences, with respect to set values, in the distances from the nozzles of the yellow inkjet recording head 112 to the nozzles of each of the other inkjet recording heads 112 due to manufacturing variation, then the control unit 124 conducts correction control by increasing/decreasing the predetermined number of clocks.

Figure 12:
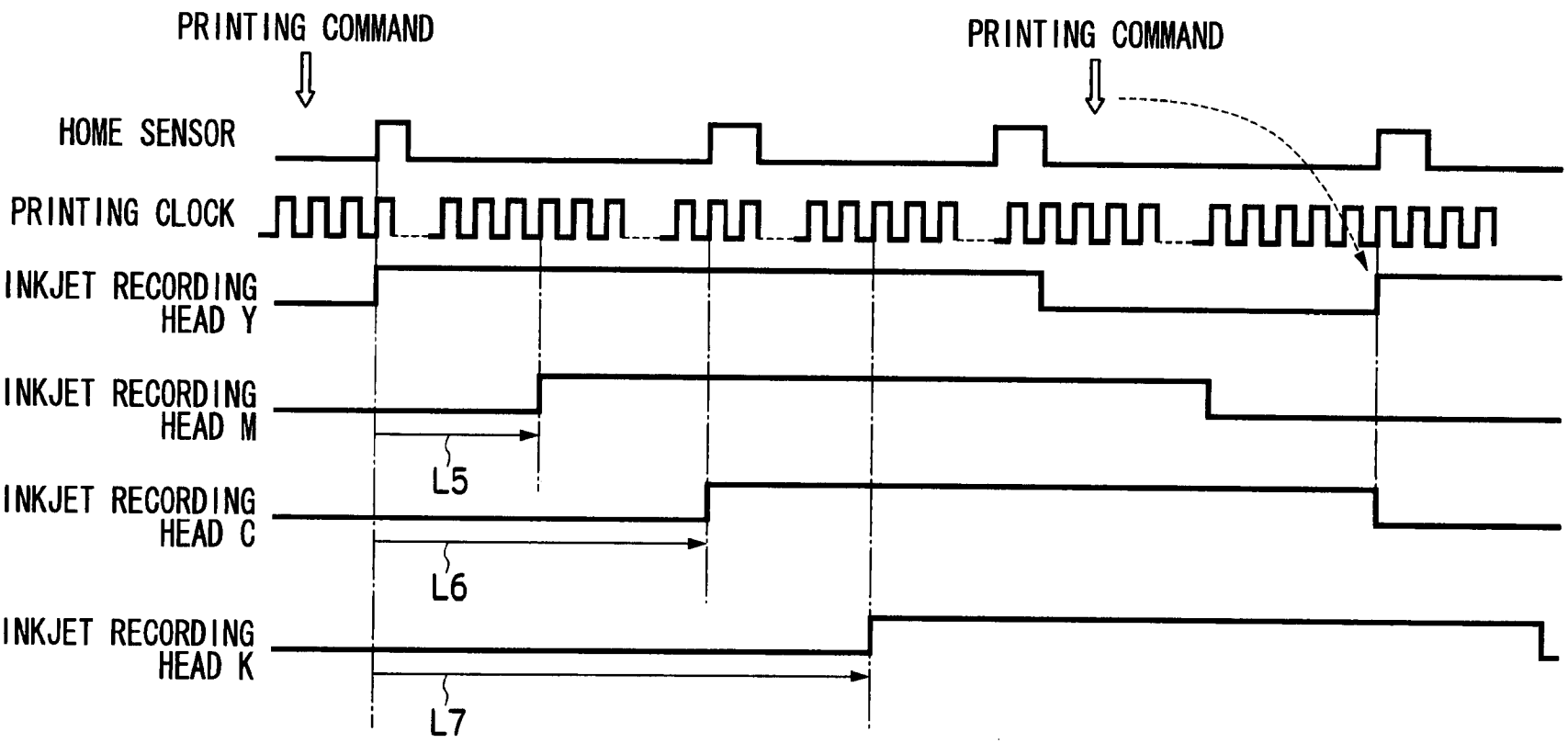
FIG. 12 is a diagram showing ejection timings of inkjet recording heads pertaining to the second exemplary embodiment of the present invention.

In FIG. 12, L5 represents the distance from the nozzles of the yellow inkjet recording head 112 to the nozzles of the magenta inkjet recording head 112, L6 represents the distance from the nozzles of the yellow inkjet recording head 112 to the nozzles of the cyan inkjet recording head 112, and L7 represents the distance from the nozzles of the yellow inkjet recording head 112 to the nozzles of the black inkjet recording head 112.

The control unit 124 generates ejection timings and sends drive signals to the magenta, cyan, and black inkjet recording heads 112 by counting the predetermined number of clocks in the printing clock. Thus, the control unit 124 causes the yellow inkjet recording head 112 to start ejecting the ink droplets and causes the inkjet recording heads 112 to eject the ink droplets in the order of magenta, cyan and black, and an image corresponding to the image information is recorded on the roll paper 102.

When the CPU 126 of the control unit 124 receives a command to print the next page from a user or the like while a predetermined page is being image-recorded, the CPU 126 causes the yellow inkjet recording head 112 to start ejecting the ink droplets in synchronization with the detection signal of the home sensor 128 that is inputted after the printing of the page being image-recorded ends.

Figure 13:
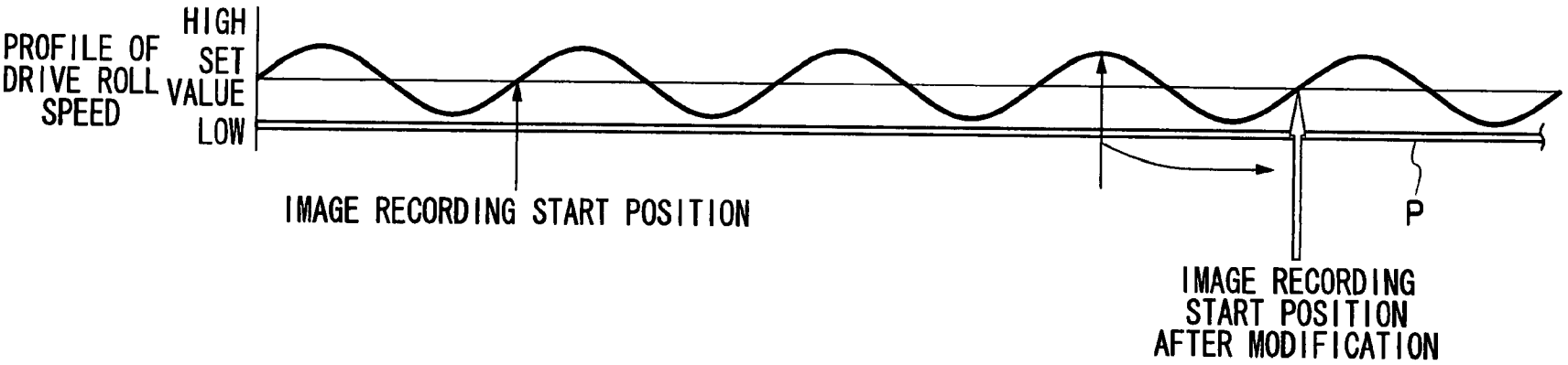
FIG. 13 is a diagram showing the relationship between variations in the speed of the drive roll and paper that is conveyed in the inkjet recording apparatus pertaining to the second exemplary embodiment of the present invention.

As described above, the control unit 124 starts the ejection of the ink droplets in synchronization with the detection signal inputted to the CPU 126 when the home sensor 128 detects the home mark, and as shown in FIG. 13, variations in the speed of the drive roll 104 arising at respective areas on the roll paper 102 become equal per page. Because variations in the speed per page become substantially the uniform, shifts in the landing positions of the ink droplets can also be made the same per page, and printing image quality between pages can be made uniform.

In the above-described first and second exemplary embodiments, an inkjet recording apparatus was described as the liquid droplet ejection apparatus that ejects liquid droplets, and inkjet recording heads were described as the liquid droplet ejection heads that eject liquid droplets. However, the liquid droplet ejection apparatus pertaining to the present invention is not limited to an apparatus that records images on recording paper, and the liquid that is ejected is not limited to ink.

For example, the present invention can be applied to all industrially used liquid droplet ejection apparatus and to liquid droplet ejection heads used in those liquid droplet ejection apparatus, such as apparatus that create display-use color filters by ejecting ink onto polymer film and glass and apparatus that form bumps for mounting parts by ejecting molten solder onto a substrate. The present invention is not limited to the above-described exemplary embodiments; various modifications, changes and improvements are possible as long as they do not depart from the spirit of the present invention.

What is claimed is:

1. A liquid droplet ejection apparatus comprising:

a conveyor portion that conveys a recording medium to a liquid droplet ejection region by the rotational force of a drive roll that rotates/drives;

liquid droplet ejection heads that record an image by ejecting liquid droplets onto the recording medium conveyed to the liquid droplet ejection region by the conveyor portion;

a detection portion that detects a rotational position of the drive roll, and that detects a timing at which the drive roll completes one rotation, by detecting a home mark disposed on the drive roll; and a control portion that controls, on the basis of the rotational position that the detection portion has detected, ejection timings at which the liquid droplet ejection heads eject the liquid droplets, so that when the drive roll reaches a predetermined rotational position, the control portion causes the liquid droplet ejection heads to start ejecting the liquid droplets onto the recording medium;

the detection portion including a detection sensor that detects the rotational position of the drive roll and sends a detection signal to the control portion, and the control portion causing the liquid droplet ejection heads to start ejecting the liquid droplets in synchronization with the detection signal sent from the detection sensor, and the control portion controlling the timing at which the liquid droplet ejection heads start ejecting the ink droplets based on the timing of the detection by the detection portion, such that the ejection of the ink droplets is started when the home mark reaches the predetermined rotational position.

2. The liquid droplet ejection apparatus of claim 1, wherein the conveyor portion includes a driven roll that is disposed facing the drive roll, nips continuous paper serving as the recording medium between the driven roll and the drive roll, and conveys the continuous paper.

3. The liquid droplet ejection apparatus of claim 1, wherein encoder film, to which ejection timing-use marks used in order to control the ejection timings at which the liquid droplet ejection heads eject the liquid droplets have been added, is disposed on the drive roll of the conveyor portion.

4. The liquid droplet ejection apparatus of claim 1, wherein a home mark serving as the detection target of the detection sensor is disposed on the drive roll of the conveyor portion, and the control portion controls, with a detection signal read from the home mark, the timing at which the liquid droplet ejection heads start ejecting the liquid droplets.

5. The liquid droplet ejection apparatus of claim 4, wherein the detection portion includes a home sensor that detects the home mark and an encoder sensor that reads ejection timing-use marks, and the control portion is connected to the home sensor, the encoder sensor, and the liquid droplet ejection heads, and controls the operation of each process.

* * * * *